US006129516A

United States Patent [19]

Wang

[11] Patent Number: 6,129,516

[45] Date of Patent: Oct. 10, 2000

[54] AIR COMPRESSOR

[76] Inventor: Hsien-Pei Wang, 1F, No. 16, Lane 135, Chung-Hsing N Street, San-Chung City, Taipei Hsien, Taiwan

[21] Appl. No.: 09/294,325

[22] Filed: Apr. 20, 1999

[51] Int. Cl.[7] ..... F04B 49/00

[52] U.S. Cl. ..... 417/36

[58] Field of Search ..... 417/36, 35, 182.5, 417/229; 55/55; 138/30

[56] References Cited

U.S. PATENT DOCUMENTS

| | | | |
|---|---|---|---|
| 3,918,844 | 11/1975 | Bailey | 417/229 |
| 4,854,945 | 8/1989 | Ferree et al. | 95/266 |
| 5,117,873 | 6/1992 | Miyakawa et al. | 138/30 |
| 5,215,124 | 6/1993 | Hattori et al. | 138/30 |
| 5,367,214 | 11/1994 | Turner, Jr. | 310/87 |
| 5,772,405 | 6/1998 | Eller | 417/233 |

*Primary Examiner*—Teresa Walberg
*Assistant Examiner*—Daniel Robinson
*Attorney, Agent, or Firm*—Bacon & Thomas, PLLC

[57] ABSTRACT

In an air compressor a collapsible air storage device is provided to accumulate high pressure air for output, the collapsible air storage device including a collapsible bag defining an air storage chamber, and a rubber cover layer covered on the collapsible bag to keep the air storage chamber in an air tight condition, the rubber cover layer shrinking and imparting a compressive force to the collapsible bag after stoppage of the air compressor, causing the collapsible bag to be collapsed.

7 Claims, 6 Drawing Sheets

AIR COMPRESSOR

BACKGROUND OF THE INVENTION

The present invention relates to an air compressor, and more particularly to a compact, light weight, portable air compressor.

A regular air compressor, as shown in FIG. 1, is generally comprised of a base frame equipped with a pair of wheels and a stand, a metal air storage cylinder fixedly mounted on the base frame, a drive unit, a compression unit driven by the drive unit to pump air into the metal air storage cylinder, a control device which controls the operation of the compression unit, and an air tube connected between the compression unit and the metal air storage cylinder to guide high pressure air from the compression unit to the metal air storage cylinder. This structure of air compressor is functional, however it is heavy, and needs much storage space. Because the air storage cylinder is made of metal, the whole assembly of the air compressor is heavy. Therefore, this structure of air compressor is not convenient for carrying by hand.

SUMMARY OF THE INVENTION

The present invention has been accomplished to provide an air compressor which eliminates the aforesaid drawbacks. According to one aspect of the present invention, the air compressor is comprised of a base frame, a drive unit mounted on the base frame, a collapsible air storage device mounted on the base frame, and a compression unit driven by the drive unit to pump air into the collapsible air storage device, wherein the drive unit is comprised of a high speed motor and a reduction gearing coupled between the high speed motor and the power input end of the compression unit. According to another aspect of the present invention, the collapsible air storage device is comprised of a collapsible air bag covered with a rubber cover layer. The rubber cover layer shrinks after expansion upon stoppage of the compression unit, thereby causing the collapsible bag to be collapsed.

DETAILED DESCRIPTION OF THE PREFERRED EMBODIMENT

Figure 1:
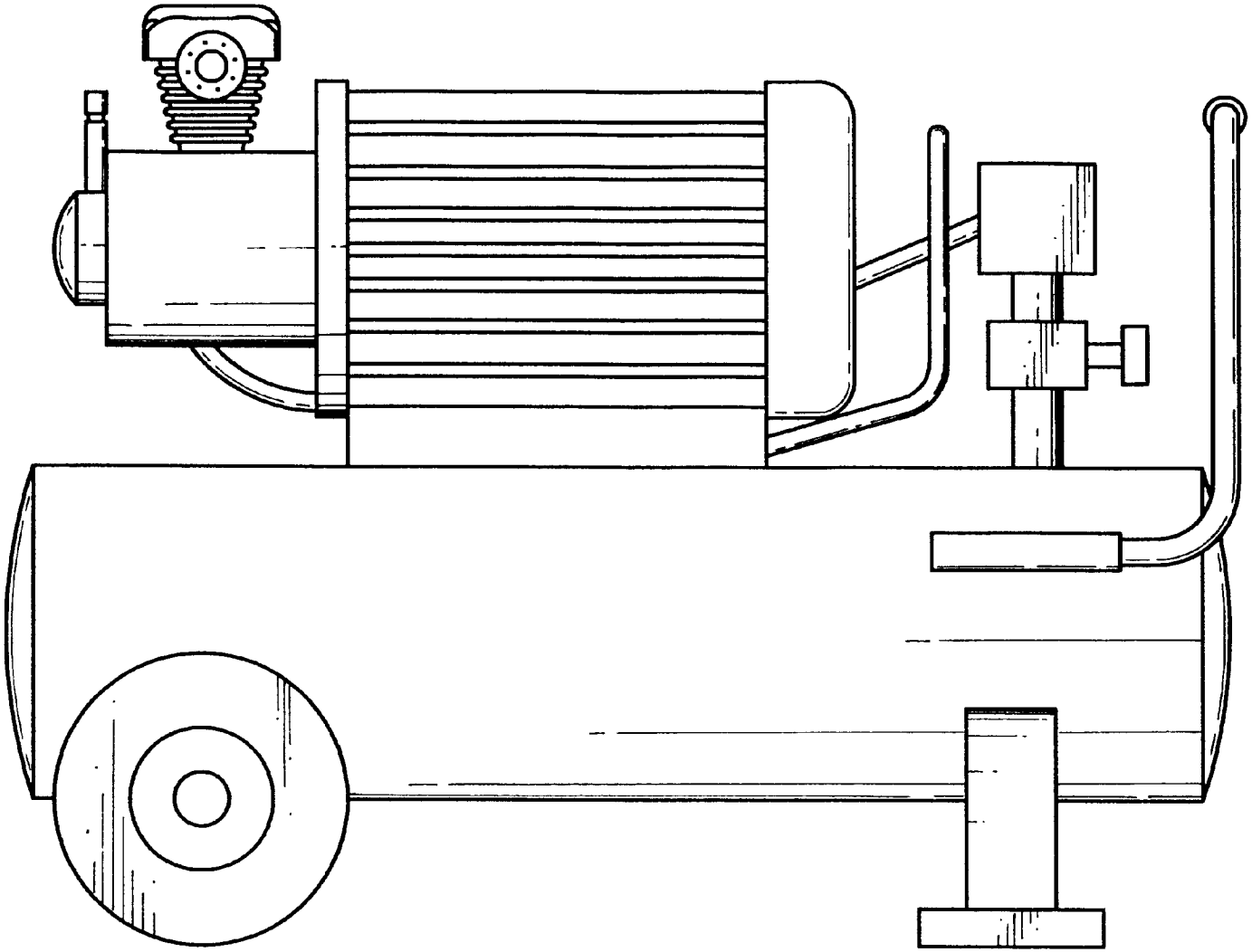
Fig. 1 PRIOR ART
FIG. 1 illustrates an air compressor according to the prior art.
Figure 2:
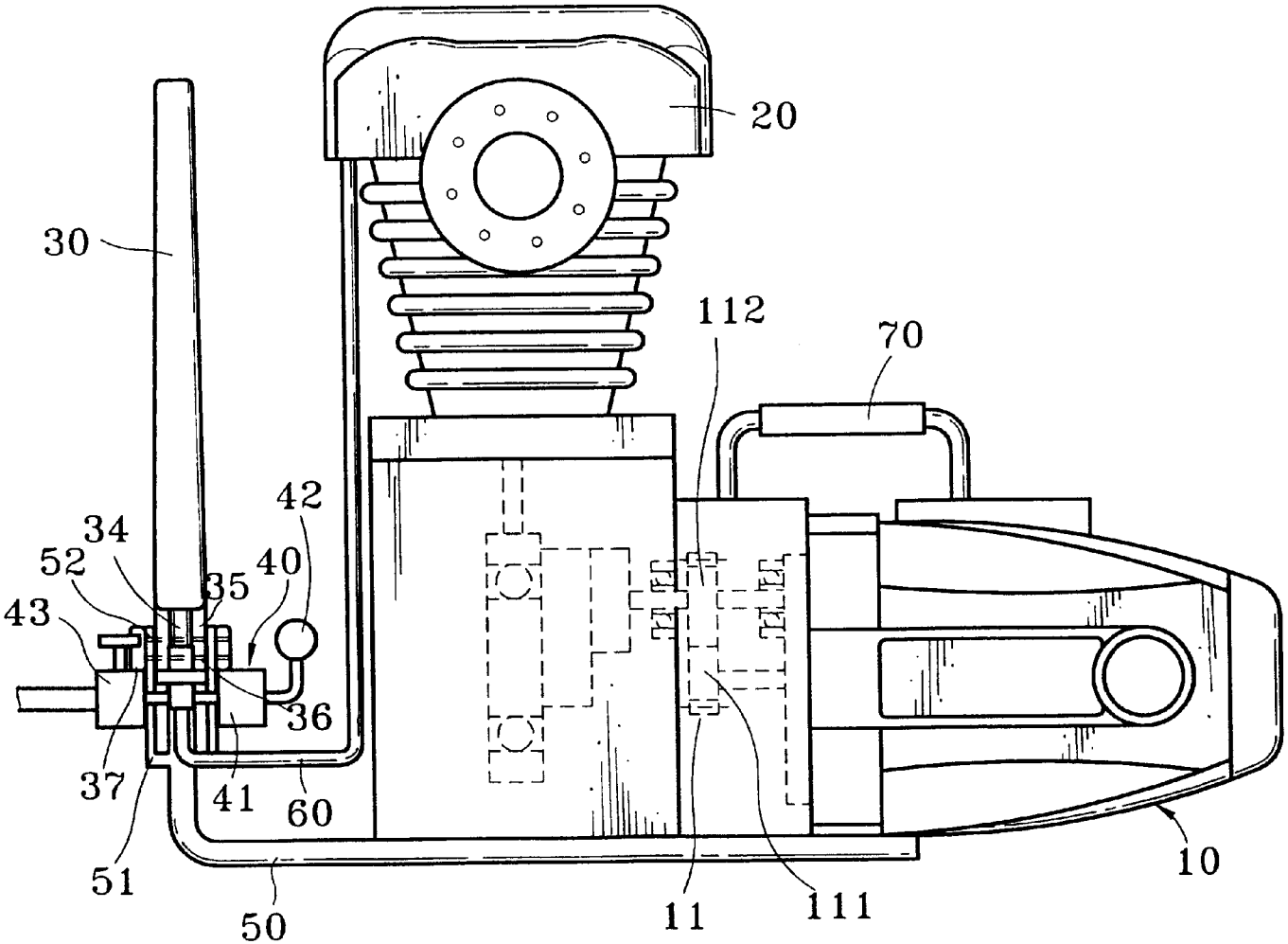
FIG. 2 is a plain view of an air compressor according to the present invention.

Referring to FIG. 2, an air compressor is shown comprised of a drive unit 10, a compression unit 20 driven by the drive unit 10 to compress air, an air storage device 30, a control device 40, and a base frame 50.

The drive unit 10 is a compact, high revolving speed motor fixedly mounted on the base frame 50 and coupled to the compression unit 20 through a reduction gearing 11, which is comprised of a set of gears 111 and 112. When operated, an output power of low revolving speed and high torque is transmitted from the reduction gearing 11 to the compression unit 20, causing the compression unit 20 to compress air smoothly.

Figure 3A:
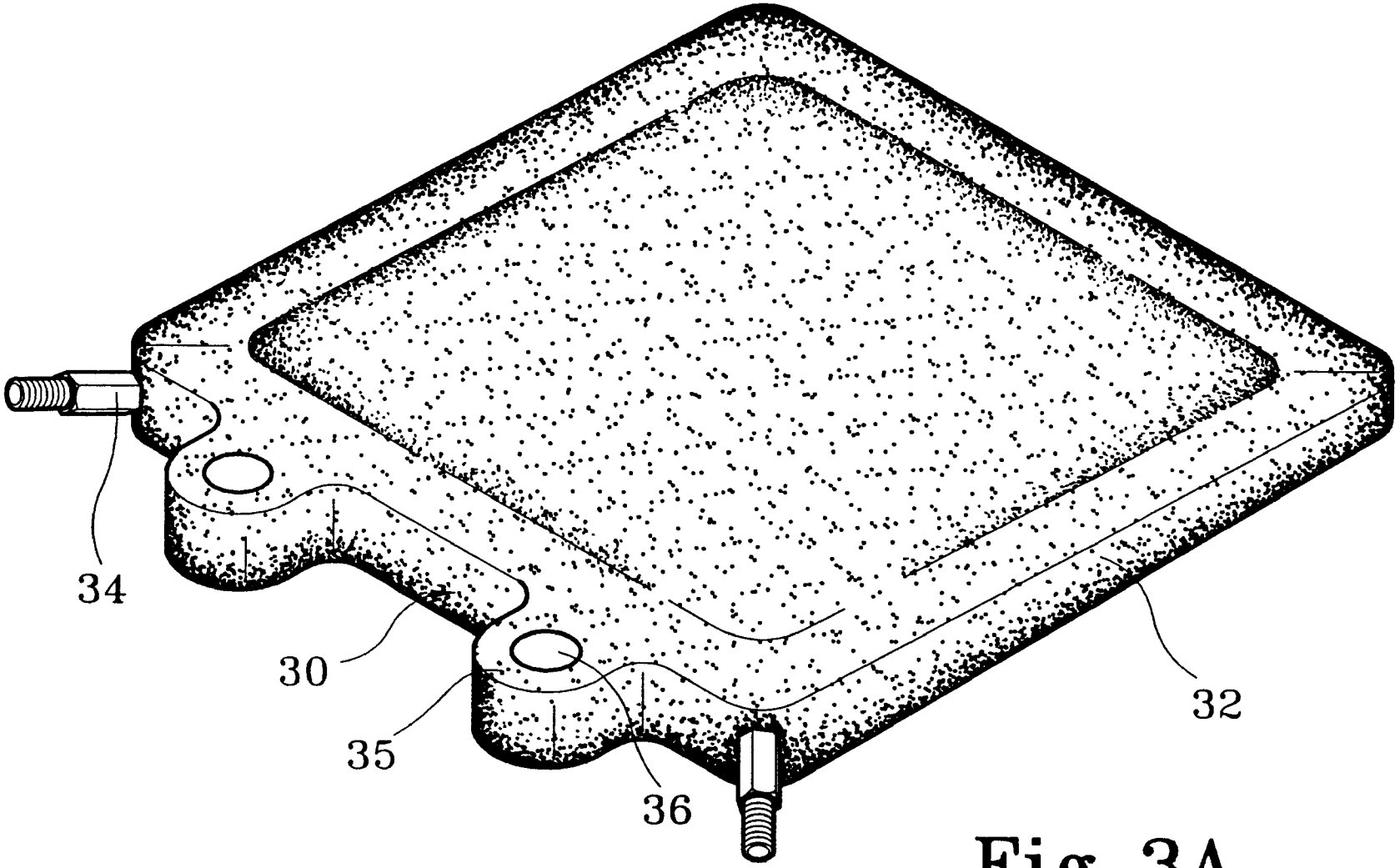
FIG. 3A is a perspective view of an air storage device according to the present invention when collapsed.
Figure 3B:
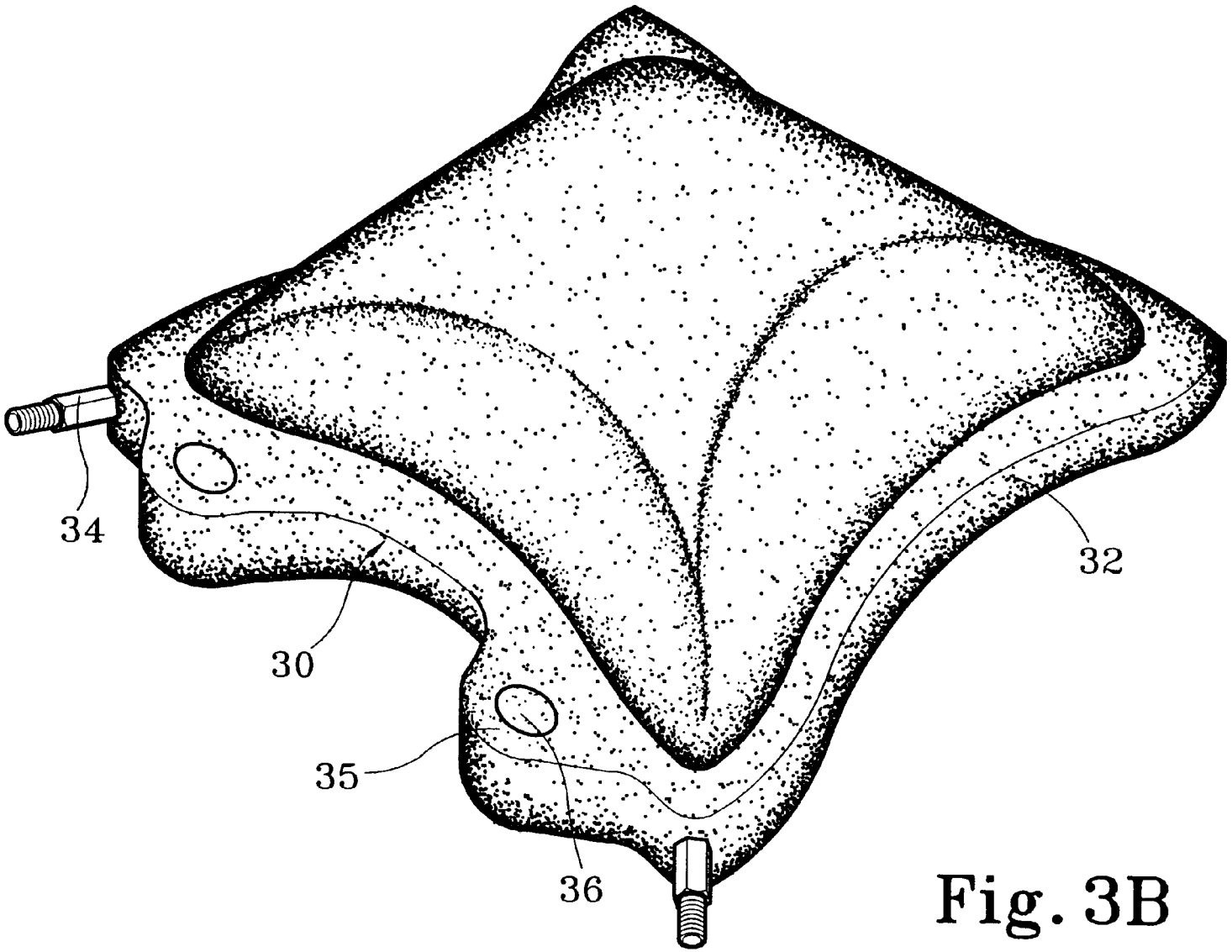
FIG. 3B shows the air storage device of FIG. 3A inflated.
Figure 4A:
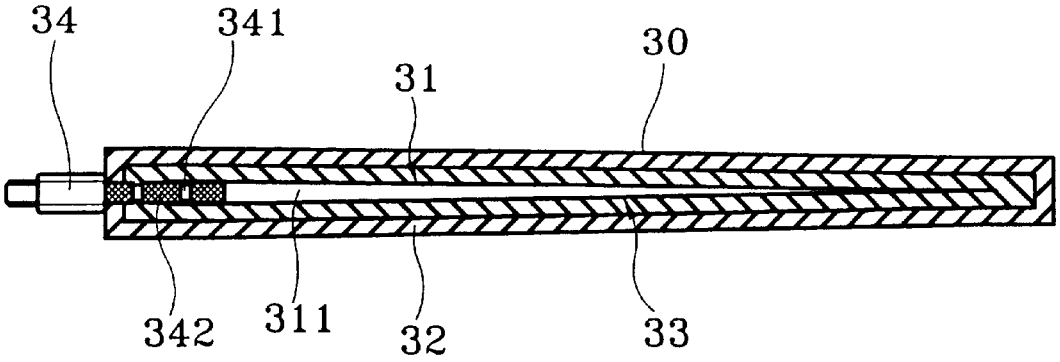
FIG. 4A is a sectional view showing the air storage device collapsed.
Figure 4B:
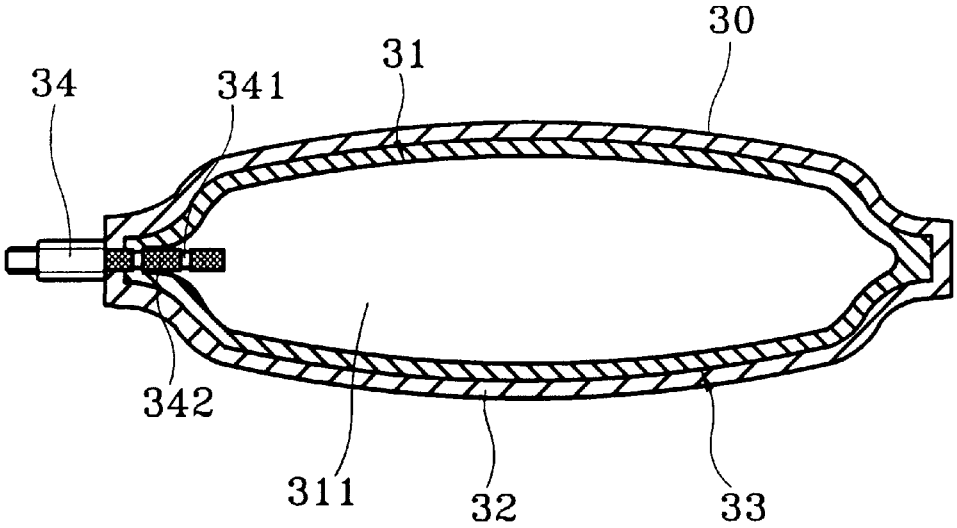
FIG. 4B is a sectional view showing the air storage device inflated.

Referring to FIGS. 3A, 3B, 4A and 4B, and FIG. 2 again, the air storage device 30 is a flexible member comprised of a bag 31 made of for example canvass and defining an air storage chamber 311, and a rubber cover layer 32 covered on the outside wall of the bag 31. During the operation of the air compressor, high pressure air is continuously forced into the air storage chamber 311 in the air storage device 30, causing the bag 31 and the rubber cover layer 32 to expand. On the contrary, when the air compressor is stopped, the rubber cover layer 32 returns to its former shape, thereby causing the bag 31 to be collapsed. Because the air storage device 30 is formed of a canvass bag covered with a rubber cover layer, it has a light weight, and can be collapsed into a flat manner. A reinforcing layer 33 which is made of polyester fiber or nylon is provided inside the rubber cover layer 32 to reinforce the structural strength of the air storage device 30. Air valves 34 are provided at the air storage device 30 for air input/output. One of the air valves 34 is provided for air input, and connected to the compression unit 20 through an air tube 60 to receive high pressure air. The other of the air valves 34 is provided for output of air from the air storage device 30 to for example a pneumatic hand tool. The air valves 34 each have an embossed outside wall 342 and annular grooves 34 around the embossed outside wall 342 for bonding of the rubber cover layer 32 during molding of the rubber cover layer 32 on the bag 31. The air storage device 30 further comprises two protruding portions 35 spaced between the air valve 34, each protruding portion 35 defining a through hole 36. Screws 37 are mounted in the through hole 36 at each of the protruding portions 35, and fastened to respective mounting holes 52 at a bracket 51 at one side of the base frame 50 to secure the air storage device 30 to the base frame 50 (see FIG. 2). FIGS. 3A and 4A show the air storage device 30 collapsed. FIGS. 3B and 4B show the air storage device 30 inflated. When inflated, the protruding portions 35 expand, and the through hole 36 at each protruding portion 35 is forced to deform. The air storage device 30 leaks when pierced by a pointed object. Because the bag 31 is protected by the reinforcing layer 33 and the rubber cover layer 32 and because the rubber cover layer 32 has a certain thickness, it does not explode when pierced by a pointed object. Therefore, the air compressor is safe in use.

As indicated in FIG. 2, the drive unit 10, the compression unit 20, the air storage device 30 and the control device 40 are mounted on the base frame 50, and the air tube 60 is connected between the air storage device 30 and the compression unit 20 to guide high pressure air from the compression unit 20 to the air storage device 30. The control device 40 is installed in the connecting area between the air storage device 60 and the air tube 60, and comprised of a safety valve 41, a pressure gage 42, and a relief valve 43. When power supply is turned on to start the motor of the drive unit 10, the compression unit 20 is driven by the reducing gearing 11 to pump air into the air storage device 30, causing the air storage device 30 to be inflated from the flat status shown in FIG. 3A to the expanded status shown in FIG. 3B. When the volume of the air storage device 30 reaches the saturated status, the control device 40 automatically stops the drive unit 10 (this operation is of the known art). On the contrary, when the pressure in the air storage device 30 drops below a predetermined value, the control device 40 starts the drive unit 10 again, causing the compression unit 20 to pump high pressure air into the air storage device 30. When not in use, the relief valve 43 is opened, enabling the air storage device 30 to be collapsed.

Figure 5:
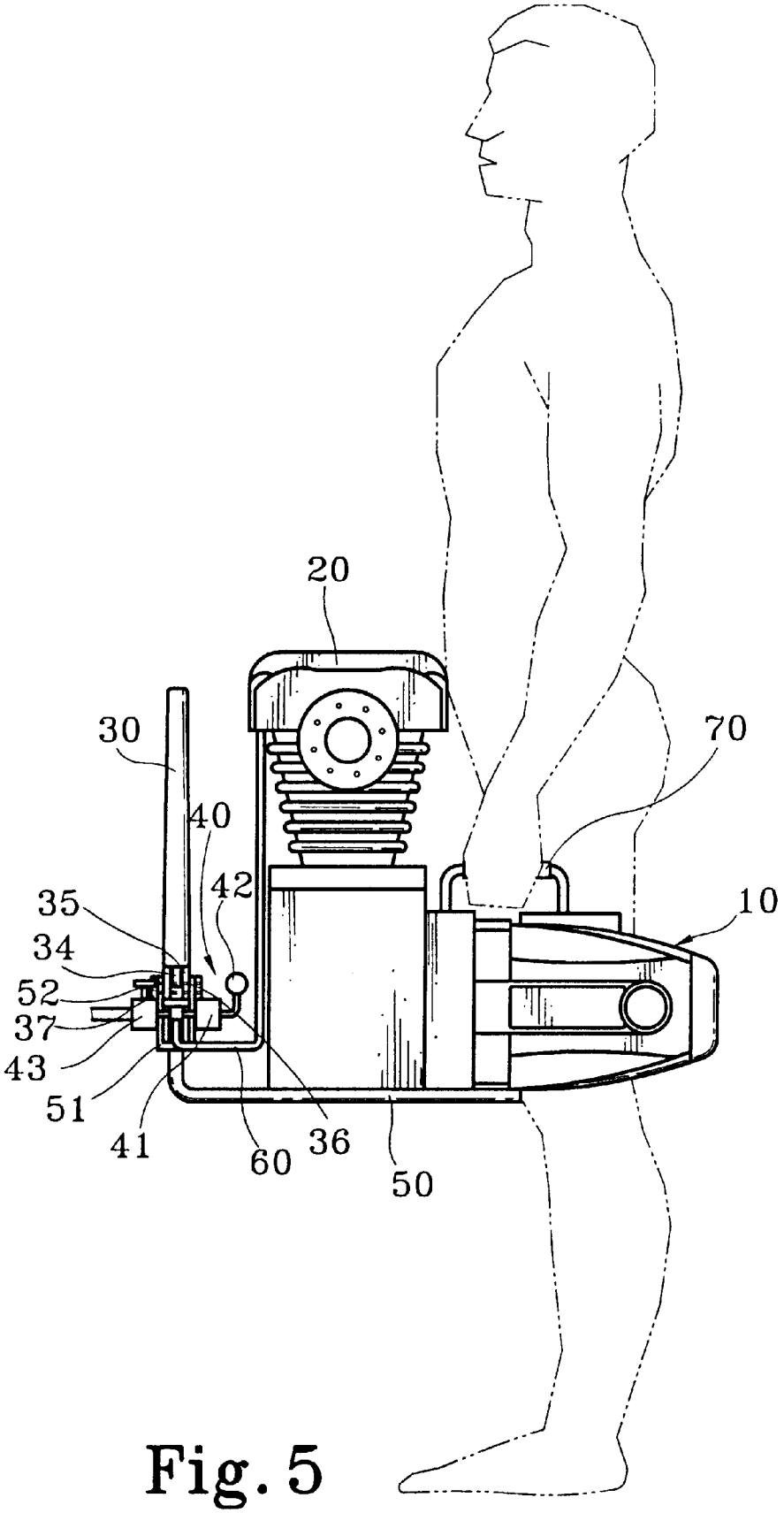
FIG. 5 shows the air compressor carried by the user.

As indicated above, the air storage device 30 has a light weight, and is collapsible. When the air storage device 30 is not inflated, the elastic material property of the rubber cover layer 32 automatically forces the rubber cover layer 32 to shrink, thereby causing the bag 31 to be collapsed. Furthermore, a handle 70 is provided at a suitable location (see FIG. 5), so that the air compressor can conveniently be carried by hand.

While only one embodiment of the present invention has been shown and described, it will be understood that various modifications and changes could be made thereunto without departing from the spirit and scope of the invention disclosed.

What is claimed is:

1. An air compressor comprising an air storage device, a drive unit, a compression unit driven by said drive unit to pump air into said air storage device, and a control device which controls the operation of said drive unit, wherein said air storage device is comprised of a collapsible bag defining an air storage chamber, a rubber cover layer covered on said collapsible bag to keep said air storage chamber in an air light condition, said rubber cover layer being forced to expand when said compression unit pumps air into said air storage device, said rubber cover layer shrinking after expansion upon stoppage of said compression unit, thereby causing said collapsible bag to be collapsed.

2. The air compressor of claim 1 wherein said air storage unit further comprising a reinforcing layer provided in said rubber cover layer.

3. The air compressor of claim 2 wherein said reinforcing layer is made of polyester fibers.

4. The air compressor of claim 1 wherein said drive unit is comprised of a high speed motor and a reducing gearing coupled to said high speed motor.

5. The air compressor of claim 4 wherein said reducing gearing is comprised of a plurality of gears.

6. The air compressor of claim 1 wherein said air storage device comprises an air input valve connected to said compression unit to receive high pressure air, and an air output valve for output of high pressure air, said air input valve and said air output valve each having at least one annular groove around the periphery thereof for positioning in said collapsible bag and said rubber cover layer.

7. The air compressor of claim 6 wherein said air input valve and said air output valve each have an embossed peripheral wall.

* * * * *